United States Patent [19]

Harris

[11] 4,337,583

[45] Jul. 6, 1982

[54] APPARATUS AND METHOD FOR DRYING A SUBSTANCE

[76] Inventor: Kenneth R. Harris, Rte. 8, Box 551, Rapid City, S. Dak. 57701

[21] Appl. No.: 263,422

[22] Filed: May 14, 1981

[51] Int. Cl.[3] ..... F26B 3/06; F26B 17/20

[52] U.S. Cl. ..... 34/33; 34/180; 34/182; 366/300; 366/607

[58] Field of Search ..... 34/179, 180, 181, 182, 34/183, 32, 33; 366/607, 297, 300, 301

[56] References Cited

U.S. PATENT DOCUMENTS

| | | | |
|---|---|---|---|
| 282,013 | 7/1883 | Slaughter | 34/66 |
| 603,612 | 5/1898 | Snyder et al. | 34/166 |
| 1,595,088 | 8/1926 | Gudger | 34/166 |
| 1,680,087 | 8/1928 | Conroy et al. | 34/166 |
| 2,022,761 | 12/1935 | Fenby | 34/180 |
| 2,864,672 | 12/1958 | Brooks, Sr. | 34/166 |
| 3,451,781 | 6/1969 | Greene | 34/166 |
| 3,532,332 | 10/1970 | McGehee | 432/104 |
| 3,556,413 | 1/1971 | Lindgren | 366/607 |
| 3,798,791 | 3/1974 | Graber | 34/164 |
| 3,828,661 | 8/1974 | Vink | 366/300 |
| 3,923,097 | 12/1975 | Hovad | 34/179 |
| 3,946,996 | 3/1976 | Gergely | 34/182 |

OTHER PUBLICATIONS

Bulletin 16-F, Koppers Company, Inc., York, PA. pp. 6-13 and p. 21.

Computer print-out on search of "Rotary Crusher Dryers", Orbit IV, S.D.C.'s International Search Service, Apr. 8, 1981.

*Primary Examiner*—Larry I. Schwartz

*Attorney, Agent, or Firm*—Merchant, Gould, Smith, Edell, Welter & Schmidt

[57] ABSTRACT

An apparatus (10) for drying a substance is disclosed. Apparatus (10) includes a pair of side-by-side cylinders (12). Drums (14) are concentrically journalled within cylinders (12). Rows of slightly spiralled chains (40) are attached to drums (14). As the drying substance moves under the influence of gravity and the velocity of a hot gas, it also is forced centrifugally outwardly so as to pass through aperture (25) to impact oncoming drying substance. The drying substance is pulverized and the drying function is accomplished more efficiently.

8 Claims, 3 Drawing Figures

APPARATUS AND METHOD FOR DRYING A SUBSTANCE

TECHNICAL FIELD OF THE INVENTION

The present invention relates to an apparatus and method for drying a substance and, more particularly, to a dryer having mechanism for circulating adjacent portions of the wet substance so as to impact one portion against the other, thereby breaking both and better allowing drying gas to perform its drying function.

BACKGROUND OF THE INVENTION

Numerous drying devices are known and are used in a variety of industries. For example, dryers are commonly used to remove moisture from such mined materials as coal, bentonite, and other substances, particularly clay-like substances. Dryers are commonly classified in two different ways. First, dryers are either batch or continuous types. As the name implies, batch dryers remove moisture from an indentifiable accumulation of a substance before starting on the next accumulation. Continuous dryers operate to remove moisture from material from the moment it is introduced into the device until the moment it leaves the device with material constantly being introduced. Secondly, dryers are classified as either direct or indirect heat dryers. A direct heat dryer uses primarily convection to move a hot, dry gas through the dryer housing. An indirect heat dryer is designed to primarily use conduction or radiation for heating the substance so as to release moisture. Direct, continuous heat dryers show the greatest similarity to the present invention.

There are three commonly recognized conditions for the efficient drying of a substance with a direct heat dryer. In particular, (1) heat must be supplied under proper control; (2) there must be exposure of the wet surfaces of the substance to the drying medium as the substance is conveyed at a controlled rate through the drying apparatus; and (3) a continuous flow of gases must be exhausted for removal of vaporized moisture. Prior art devices do, of course, supply heat and show mechanisms for continually exhausting vaporized moisture. The devices differ in the provision of how wet surfaces of the substance are exposed to the drying medium.

A particularly popular direct heat dryer is called a rotary dryer. These mechanisms are generally massive cylinders which are rotated. The wet substance is introduced at one end. As the substance rotates with the cylindrical housing, it falls away from the side and back toward the bottom. Baffles are sometimes used to prevent the substance from falling away from the side too rapidly. If the substance cakes or otherwise sticks to the side of the cylindrical housing, knockers are installed to bang the side of the housing thereby shocking the wall so as to release the substance from the inner side. Alternatively, chains are attached to the inner wall. The wet substance rests on the chains so that as the cylindrical housing rotates, the substance is forced to fall away from the inner wall as the chains fall downwardly away from the wall.

Other drying mechanisms show the use of rotating shafts having paddles or other stationary stirring elements attached thereto. The stirring elements apparently mix the wet substance so as expose as much of the substance as possible to the drying medium.

The prior art, however, has not satisfactorily addressed the condition of providing maximum exposure of the wet substance to the drying medium. The problem is especially drawn into focus when observing entire industries building huge plants which simply grind a substance which has been previously dried into a cake-like aggregate.

SUMMARY OF THE INVENTION

The present invention relates to an apparatus and method for drying a substance. The apparatus for drying a substance comprises housing means for containing the drying substance wherein the housing means has a side wall defined by a cylindrical tube. A shaft is journaled concentrically to the tube. Means for rotating the shaft is provided. Additionally, means for flexibly flailing the substance is attached to the shaft. The flailing means extends generally to the side wall of the tube. In this fashion, the flailing means keeps the substance agitated within the housing thereby promoting drying.

The method for drying a wet substance in accordance with this invention includes feeding the wet substance into a housing with a cylindrical side wall having a concentrically journaled shaft. The wet substance is then pulverized and suspended with flexible flailing members attached to the shaft and reaching generally to the side wall of the housing. Heated dry gas is passed through the pulverized and suspended substance to dry it. Then, the gas and the dried substance are exhausted from the housing.

A preferred embodiment of the invention has a housing including a pair of side-by-side cylindrical members. The cylindrical members have a side wall and first and second end walls which define a hollow cylindrical interior. The cylindrical members are longitudinally connected along the side walls so as to define an aperture interconnecting the interiors of the adjacent cylindrical members for allowing communication of the substance between the cylindrical members. Cylindrical drums are concentrically journaled to the end walls of each of the cylindrical members, the drums being rotatable in the same direction. There is a drive means for rotating the shafts at an appropriate speed. A plurality of chains for striking, moving, and pulverizing the substance are attached to the shafts. The chains are aligned in slightly spiraling rows, the rows of chains in adjacent cylinders being offset from each other. The chains extend radially outwardly generally to the side walls as the shafts rotate. The chains, however, do not touch the side walls.

Hot, dry gas and the wet substance to be dried are fed into one end of the housing. The housing is inclined to allow for gravity flow of the substance. Gases including vaporized moisture are exhausted from the housing. Similarly, an exit is provided for at least a portion of the dried substance.

Thus, the present invention advantageously provides a very efficient drying apparatus and method. Heat is continuously supplied and evenly distributed throughout the substance. There is a continuous flow of gases through the drying apparatus to meet the needs of the heat supply and removal of water vapor. The unique shape of the housing and configuration of the flailing members or chains function to expose the maximum surface area of the substance to be dried to the drying medium. Wet substance is not only struck by the flailing chains, but is moved about the cylindrical chambers in a spiral-like fashion under the influence of the force of gravity. Centrifugal force causes the substance to travel generally along the side walls. As the rotating substance moves into the aperture region between adjacent chambers, the substance tends to travel from one chamber to another. In so doing, the substance from one chamber impacts the substance from the other chamber, thereby pulverizing clumps and exposing the greatest possible surface area of the substance to the drying medium.

Another advantage of the present invention is that the chains or flexible flailing members may be attached in a slightly reverse spiral so as to slow the travel of the wet substance from one end of the housing to the other. At the same time, the speed at which the wet substance travels through the housing may be regulated by the axial incline of the cylindrical members of the housing. In this way, wet substance is slowed most in the input region where drying is the greatest; also, the wet substance is slowed to a rate which is readily controllable by inclining the housing.

An important result from use of the present invention is that a dried substance is pulverized to a very great extent. Generally, a clay cutter or other grinder must be used to break a dried substance to a commercially usable size. With the present invention, a large portion of the dried substance is immediately usable. For example, bentonite is a clay-like substance which is dried and ground for such uses as a sealing compaction for the walls of drill holes in oil fields. In a recent test, it was found that approximately one-half the bentonite dried with the present invention was immediately usable without further grinding.

In conjunction with the previously discussed advantage and of even greater importance is the tremendous potential savings of fuel which is realized by using a dryer in accordance with the present invention as compared with prior art dryers. In a recent test, 800 pounds of bentonite was dried from a natural moisture content of 22–32% to a usable moisture content of 7–11%. When comparing the energy used per pound of dried material with that typically used in a state-of-the-art plant, an energy savings greater than 20% was realized. Such results are extremely exciting in view of present energy shortages throughout the world.

These and other various advantages and features of novelty which characterize the present invention are pointed out with particularity in the claims annexed hereto and forming a part hereof. However, for a better understanding of the invention, its advantages, and objects obtained by its use, reference should be had to the drawings which form a further part hereof, and to the accompanying descriptive matter, in which there is described a preferred embodiment of the invention.

DETAILED DESCRIPTION OF THE INVENTION

Figure 1:
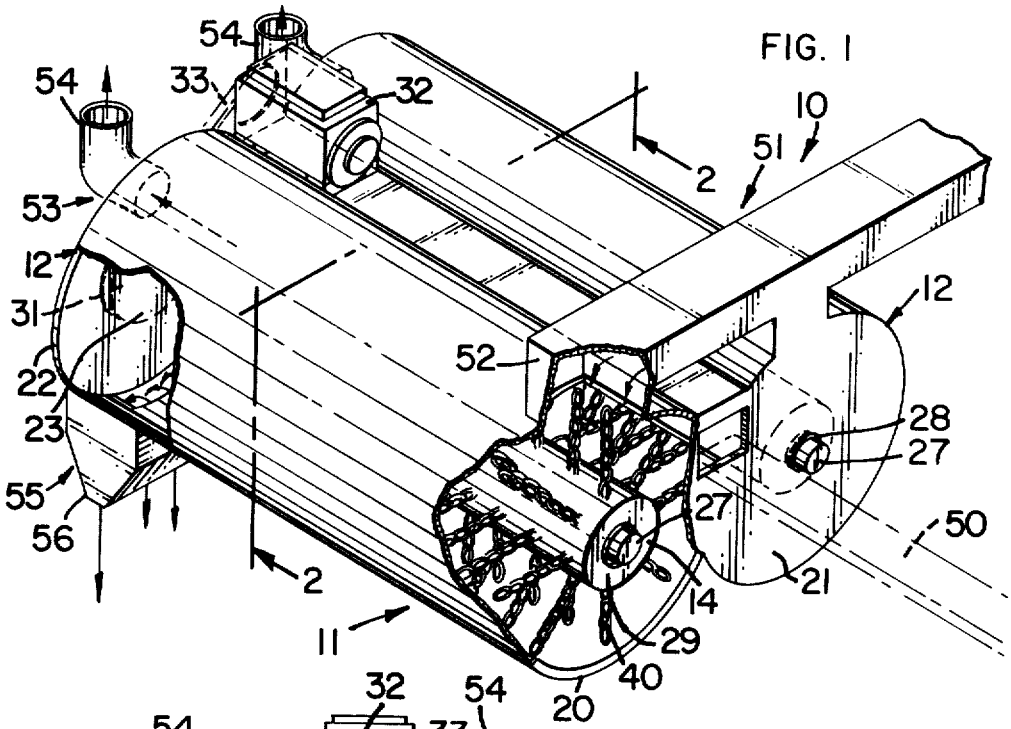
FIG. 1 is a partially cut-away, perspective view of an apparatus in accordance with the present invention.

An apparatus in accordance with the present invention is identified generally by the numeral 10 in FIG. 1. Apparatus 10 includes a housing 11 comprised of side-by-side chambers 12, chambers 12 being cylinders in a preferred embodiment. A cylindrical shaft or drum 14 is concentrically journaled in each of cylinders 12. Flailing members 16 are attached to each of drums 14.

The cylinders 12 have a side wall 20 and first and second end walls 21 and 22, respectively, which define a hollow cylindrical interior 23. The cylinders 12 are connected at generally tangential locations along side walls 20. An aperture 25 interconnects and provides fluid communication between cylinders 12. Aperture 25 allows for communication of the substance to be dried between cylinders 12.

Figure 3:
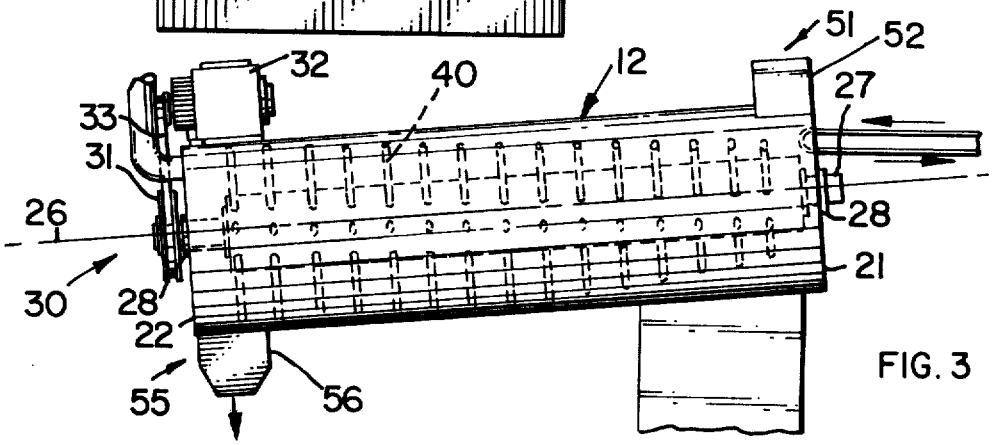
FIG. 3 is a side view showing internal elements in phantom lines.

FIG. 3 shows the cylinders 12 as having an inclined longitudinal axis 26. The inclined longitudinal axis 26 maintains the substance in a gravity-induced flowing condition with the flow being from the first end wall 21 to the second end wall 22.

As previously mentioned, a drum or shaft 14 is concentrically journaled in each cylinder 12. That is, in a fashion familiar to those skilled in the art, a shaft 27 passes through an opening in end wall 21 and extends through a drum 14 to pass through a similar opening in the opposite end wall 22. Shaft 27 is journaled at each end wall with a bearing 28. Drum 14 is fixedly attached to shaft 27 by welding or otherwise at end plates 29 of drum 14. Additional structure within drum 14 for attachment to shaft 27 is appropriate, although not shown, as well. Appropriate retaining devices, not shown, depending on the size of drier 10 are used to prevent shafts 27 from moving longitudinally with respect to housing 12.

A drive mechanism 30 rotates shafts 27 and drums 14 in identical directions. For example, pulleys 31 may be fastened to shaft 27 where shafts 27 protrude beyond end plates 22. A motor 32 or other power device may be used in conjunction with a belt 33 to drive such pulleys 31. Such a drive mechanism is commonly known and it or any of several others may be used equally well with the present invention.

Figure 2:
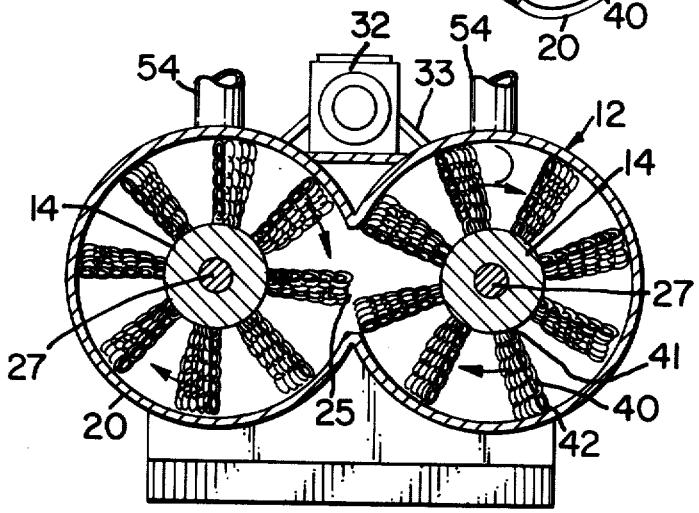
FIG. 2 is a cross-sectional view, taken along line 2—2 of FIG. 1.

The flailing means include rows of chains 40 connected by welding or otherwise at one end 41 to the drums 14. It is advantageous, although not necessary, to give the rows of chains 14 a slight spiral curvature as the rows extend from end wall 21 to end wall 22. The spiral is designed to retard the advance of substance from the input to output ends of the housing 11. That is, if drums 14 rotate clockwise as shown in FIG. 2, the spiral would also advance in a clockwise direction around a drum 14. Such a retarding spiral of rows of chains 40 allows the inclining of axis 26 to provide a more sensitive adjustment in conjunction with the velocity of hot gas, for the rate of substance travel from input to output.

The unattached ends 42 of the chains 40 extend radially outwardly generally to the side walls 20 of the cylinders 12 as the drums 14 rotate. Chains 40 do not ever touch side walls 20, however. Each row of chains 40 in one cylinder 12 is offset from the rows of chains 40 of the adjacent cylinder 12 such that the rows are interspaced among each other as they move past aperture 25. Such an offset condition aids in breaking apart the substance to be dried thereby suspending it in housing 11 and allowing it to communicate between adjacent cylinders 12. It should be understood that while the preferred embodiment makes mention of chains 40, any flexible member is suitable to perform the functions described.

Dryer 10 includes a conveyor, auger, or other mechanism 50 commonly known to those skilled in the art for feeding the substance into cylinders 12. Dryer 10 further includes a mechanism 51 for heating and vaporizing moisture in the substance to be dried. Hot gas is commonly blown into cylinders 12 via a duct 52 at the top of cylinders 12. A gas removing mechanism 53 connected via a ducting 54 proximate a portion of end walls 22 of cylinders 12 removes the hot gases and water vapor from housing 11. The gas removing mechanism 53 also removes fine particles of the dried substance. These fines are screened and are generally of a suitable size for commercial use. A retrieving mechanism 55 proximate another portion of end wall 22 of cylinders 12 removes the larger particles of the dried substance via an exit duct 56. The larger dry material then may be carried away by a conveyor mechanism or other similar means.

The present invention is particularly effective because of the interaction of the wet substance between the pair of cylindrical chambers 12. Since drums 14 travel in the same rotational direction, the drying substances within the two chambers 12 are traveling in opposite directions at apertures 25. The drying substance from one chamber 12 is being influenced by centrifugal force and, when it reaches aperture 25, it travels through to the other chamber 12. At that point, however, the substance from both chambers impacts. The substance slows and encounters chains 40. Both the interaction of substance from both chambers 12 at aperture 25 and the striking of the substance by chains 40 function to generally break and pulverize the material. The resulting finer particles are not only more effectively and efficiently dried, but they exit dryer 10 in a state ready or nearly ready for commercial use.

The present invention further reveals a method for drying a substance. A wet substance is fed via conveyor mechanism 50 into housing 11 proximate first end wall 21. The substance is pulverized and suspended in housing 11 by chains 40 attached to drums 14 which are rotated in the same direction. The substance is simultaneously heated by heat mechanism 51, and moisture is removed. The substance is communicated between cylinders 12, rotated about cylinders 12, and moved longitudinally in cylinders 12 from proximate first end wall 21 to proximate second end wall 22 where the substance is retrieved by the retrieving mechanism 55. Moisture-laden gases are removed by mechanism 53.

Thus, numerous characteristics and advantages of the invention have been set forth in the foregoing description, together with details of the structure and function of the invention. The novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. A method for drying a wet substance, said method comprising the steps of:

a. moving said wet substance into side by side first and second housings with an elongated aperture therebetween for providing communication of said substance between said housings;

b. imparting motion to said wet substance in each housing;

c. causing said wet substance from one of said first and second connected housings to impact said wet substance from the other of said first and second connected housings at said aperture thereby pulverizing said substance;

d. passing dry gas through said substance to dry said substance;

e. exhaustng said gas from said housings; and f. directing said dry, pulverized substance from said housings.

2. An apparatus for drying a substance, comprising:

means for containing said drying substance, said containing means incuding a pair of tubular housings disposed in side by side relation and connected along a longitudinal side thereof, said containing means having an aperture extending along a substantial portion of said connected side for providing fluid communication of said substance through said aperture between adjacent housings;

a pair of shafts, each said shaft being journaled concentrically with respect to one of said housing;

means for rotating said shafts; and, means, attached to each said shaft, for flailing said substance, said flailing means extending approximately to the side of said respective housing;

whereby said flailing means agitates said substance between the various housings thereby promoting drying.

3. An apparatus in accordance with claim 2 wherein each said shaft rotates about an axis in a space divisible into quadrants about each said axis and wherein said flailing means comprises a row of flexible members connected to and extending from each said shaft in each said quadrant.

4. An apparatus in accordance with claim 3 wherein said flexible members are chains.

5. An apparatus for drying a substance, comprising:

housing means defining a pair of chambers with elongated adjacent side walls, said housing means including opening means for communicating said substance between said chambers along a substantial portion of said elongated adjacent side walls;

input means for introducing said substance into said housing means;

means for agitating said substance within and between said chambers through said opening means;

means, within said housing means, for evaporating liquids entrained in said substance; and, output means for allowing said dry substance to exit from said housing means.

6. An apparatus in accordance with claim 5 wherein said agitating means includes means within each chamber for flailing said substance, the flailing means within one chamber cooperating with the flailing means within the other chamber to agitate said substance within and between both chambers.

7. An apparatus in accordance with claim 1 wherein said agitating means includes drive means for rotating each said flailing means, said drive means operating to rotate both said flailing means in the same rotative direction whereby substance passing from one said chamber to the other said chamber impacts oncoming substance thereby breaking into small particles for more efficient drying by said evaporating means.

8. An apparatus for drying a substance, comprising:

housing means having first and second sidy-by-side cylindrical chambers, said housing means comprising means for communicating said substance between said chambers over a substantial portion of the length thereof;

input means for introducing said substance into said first and second chambers of said housing means;

means for moving said substance rotatively in each chamber causing said substance to move outwardly under the influence of centrifugal force, said moving means operating over a substantial portion of the length of said chambers, the outwardly moving substance from said first chamber encountering at said communicating means the outwardly moving, oppositely directed substance from said second chamber there-by impacting and breaking said substances into small pieces for efficient drying;

means, within said housing means, for evaporating liquids entrained in said substance; and, output means for allowing said substance to exit from said housing means.

* * * * *